US009167916B2

(12) United States Patent
Grant et al.

(10) Patent No.: US 9,167,916 B2
(45) Date of Patent: Oct. 27, 2015

(54) MERCHANDISE DISPLAY HOOK WITH ALARM

(71) Applicant: InVue Security Products Inc., Charlotte, NC (US)

(72) Inventors: Jeffrey A. Grant, Charlotte, NC (US); Andrew W. Moock, Brecksville, OH (US); Gregory C. Schultz, Huntersville, NC (US); David N. Berglund, Charlotte, NC (US); Gary A. Taylor, Fort Mill, SC (US); James K. Sankey, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

(21) Appl. No.: 14/294,807

(22) Filed: Jun. 3, 2014

(65) Prior Publication Data

US 2014/0352372 A1 Dec. 4, 2014

Related U.S. Application Data

(60) Provisional application No. 61/830,726, filed on Jun. 4, 2013, provisional application No. 61/841,594, filed on Jul. 1, 2013.

(51) Int. Cl.
*G08B 13/14* (2006.01)
*A47F 5/08* (2006.01)

(52) U.S. Cl.
CPC ..... *A47F 5/0861* (2013.01); *G08B 13/1463* (2013.01); *Y10T 70/5004* (2015.04)

(58) Field of Classification Search
CPC ..... A47F 5/0861; Y10T 70/5004
USPC ..... 340/568.1, 568.4, 568.8, 571; 70/57.1; 248/551
See application file for complete search history.

(56) References Cited

U.S. PATENT DOCUMENTS

| | | | | |
|---|---|---|---|---|
| 6,474,478 | B1 | 11/2002 | Huehner et al. | |
| 7,131,542 | B2 | 11/2006 | Sedon et al. | |
| 7,213,722 | B2 | 5/2007 | Nagelski et al. | |
| 7,703,308 | B2 | 4/2010 | Nagelski | |
| 7,847,692 | B2 | 12/2010 | Schuller | |
| 8,443,988 | B2 | 5/2013 | Niederhuefner | |
| 8,542,119 | B2 * | 9/2013 | Sankey | 340/568.1 |
| 8,629,772 | B2 | 1/2014 | Valiulis et al. | |
| 2010/0175438 | A1 | 7/2010 | Sankey | |
| 2011/0215060 | A1 | 9/2011 | Niederhuefner | |
| 2011/0218889 | A1 | 9/2011 | Westberg et al. | |
| 2013/0141240 | A1 | 6/2013 | Valiulis et al. | |
| 2013/0152367 | A1 | 6/2013 | Casey | |
| 2014/0070948 | A1 | 3/2014 | Valiulis et al. | |
| 2014/0197953 | A1 | 7/2014 | Valiulis et al. | |

* cited by examiner

*Primary Examiner* — Toan N Pham
(74) *Attorney, Agent, or Firm* — InVue Security Products Inc.

(57) ABSTRACT

Display hooks for displaying items of merchandise are provided. For example, the display hook includes at least one rod for supporting a plurality of items of merchandise and an end assembly coupled to the at least one rod. The end assembly includes an alarm mechanism configured to generate at least one alarming signal. The end assembly is configured to detect removal of each item of merchandise, wherein the alarm mechanism does not generate an alarming signal when at least a first item of merchandise is removed from the rod, and wherein the alarm mechanism is further configured to generate an alarming signal when a second item of merchandise has been removed from the rod within a predetermined period of time from the first item of merchandise being removed.

19 Claims, 5 Drawing Sheets

MERCHANDISE DISPLAY HOOK WITH ALARM

CROSS REFERENCE TO RELATED APPLICATIONS

This application claims the benefit of priority to U.S. Provisional Application No. 61/830,726 filed on Jun. 4, 2013 and U.S. Provisional Application No. 61/841,594 filed on Jul. 1, 2013, the entire disclosures of which are incorporated herein by reference.

BACKGROUND OF THE INVENTION

Embodiments of the present invention relate generally to a merchandise display hook for items of merchandise.

It is common practice for retailers to display items of merchandise on a security device, such as a display hook or a display fixture. The security device displays an item of merchandise so that a potential purchaser may examine the item when deciding whether to purchase the item. The small size and relative expense of the item, however, makes the item an attractive target for shoplifters. A shoplifter may attempt to detach the item from the security device, or alternatively, may attempt to remove the security device from the display area along with the merchandise.

Some display hooks require a key for removal or generate an alarm when an item of merchandise is removed. However, the requirement of a key can be inconvenient for a legitimate customer, while the generation of an alarm each time an item of merchandise is removed can be annoying to the customer and unnecessary in some circumstances.

BRIEF SUMMARY

Embodiments of the present invention are directed to display hooks and methods for displaying items of merchandise. In one embodiment, a display hook includes at least one rod for supporting a plurality of items of merchandise and an end assembly coupled to the at least one rod. The end assembly includes an alarm mechanism configured to generate at least one alarming signal. The end assembly is configured to detect removal of each item of merchandise from the rod, wherein the alarm mechanism is configured to generate a first alarming signal when a first item of merchandise is removed from the rod and to generate a second alarming signal when a second item of merchandise is removed from the rod within a predetermined period of time of the first item of merchandise being removed, and wherein the second alarming signal has a greater volume, intensity, and/or duration than the first alarming signal.

In another embodiment, a display hook for displaying items of merchandise is provided. The display hook includes at least one rod for supporting a plurality of items of merchandise and a sensor operably engaged with the at least one rod and configured to detect removal of the items of merchandise from the at least one rod. The display hook also includes an alarm mechanism in communication with the sensor and configured to generate at least one alarming signal. The alarm mechanism is configured to not generate an alarming signal when at least a first item of merchandise is removed from the rod, and the alarm mechanism is further configured to generate an alarming signal when at least a second item of merchandise has been removed from the rod within a predetermined period of time from the first item of merchandise being removed.

In one embodiment, a display hook for displaying items of merchandise is provided and includes at least one rod for supporting a plurality of items of merchandise and an end assembly coupled to the at least one rod. The end assembly includes an alarm mechanism configured to generate at least one alarming signal, and the end assembly is configured to detect removal of each item of merchandise. The alarm mechanism is configured to not generate an alarming signal when at least a first item of merchandise is removed from the rod, and the alarm mechanism is further configured to generate an alarming signal when at least a second item of merchandise has been removed from the rod within a predetermined period of time from the first item of merchandise being removed.

In another embodiment, a method for protecting an item of merchandise from theft is provided. The method includes detecting removal of at least a first item of merchandise from a rod and detecting removal of at least a second item of merchandise from the rod. The method further includes generating a first alarming signal when the second item of merchandise is removed from the rod within a predetermined period of time from the first item of merchandise being removed.

DETAILED DESCRIPTION OF THE INVENTION

Figure 1:
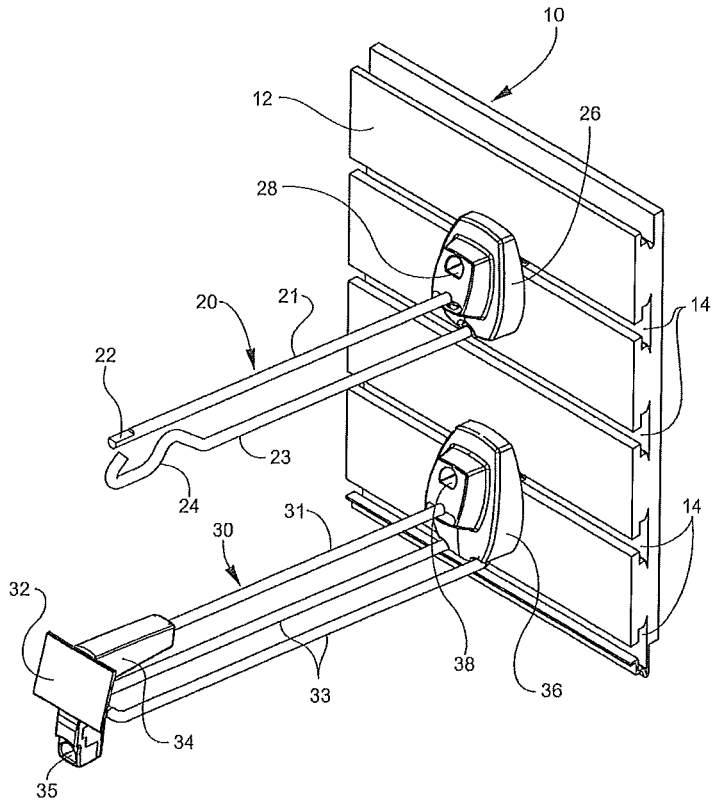
FIG. 1 is a perspective view of merchandise display hooks mounted on a display support according to one embodiment of the present invention.

Embodiments of the present invention will now be described more fully hereinafter with reference to the accompanying drawings, in which exemplary embodiments of the invention are shown. This invention may, however, be embodied in many different forms and should not be construed as limited to the embodiments set forth herein. Rather, the exemplary embodiments are provided so that this disclosure will be thorough and complete, and will fully convey the scope of the invention to those skilled in the art.

Embodiments of the present invention are directed to merchandise display hooks. The display hook may be one of the type commonly used to display one or more items of merchandise within a display area of a retail store. By way of example, and not by limitation, the display hook is a merchandise display hook for displaying relatively, small, expensive consumer products, for example compact discs (CDs), digital video discs (DVDs), battery packs, electronic devices, etc., on a display support. The display support could be any suitable support, such as pegboard, wire grid, horizontal bar rack, slatwall (also known as slatboard), wall, table, desk, countertop or other secure structure. Other examples of a display hook according to the present invention without limitation include merchandise display fixtures. In some example embodiments, the display hooks are similar to the locking hooks and flexible looking hooks manufactured by InVue Security Products Inc.

In one embodiment, the display hook includes at least one rod configured to engage and extend outwardly from a display support. For example, the display hook may include a pair rods (see, e.g., FIGS. 1-5), such as an upper rod and a lower rod, or a single rod (see, e.g., FIG. 6). The rods may be generally straight members in some embodiments, although one or both rods may be helical in other embodiments. The rods may extend substantially parallel to one another when supported on the display support. In some embodiments, the display hook is configured to engage and be supported by the display support. In other embodiments, the display hook is configured to lock to the display support such that the display hook may not be removed from the display support without the use of a key, such as with a mechanical and/or an electronic key. In this regard, the display hook may include a base assembly that is configured to engage the display support (see, e.g., FIGS. 4-5). According to some embodiments, a lockable base assembly suitable for use with the display hook is shown and described in U.S. Pat. No. 8,341,987 entitled Security Device For Attaching A Peg Hook To A Peg Support, the entire disclosure of which is incorporated herein by reference. One example of a magnetic key suitable for use with the display hook and/or lockable base is shown and described in United States Patent Application Publication No. US 2008/0168811 A1 entitled Magnetic Key For Use With A Security Device, the entire disclosure of which is incorporated herein by reference. The key may also be similar to those manufactured by InVue Security Products Inc., such as the OM, S3, Q4, IR, IR2, and IR2-S keys.

The display hook may also include an end assembly configured to be secured to an end of one or more rods. It is understood that the end assembly may be coupled to the rod at any desirable location thereon, such as at a free end of the rod, proximate the free end of the rod, or spaced away from the free end of the rod towards the opposite end of the rod. For instance, the end assembly could be spaced a distance from the free end of the rod. The end assembly may be secured to the rod(s) such that items of merchandise may be not removed without first removing the end assembly from the rod with a key. In one embodiment, the key is a magnetic key and may be the same key used to unlock the base assembly. In one particular embodiment, the display hook is similar to that disclosed in U.S. Pat. No. 7,703,308, entitled Display Hook Assembly Having A Secure Free End, the contents of which are hereby incorporated by reference in its entirety.

In alternative embodiments, the end assembly may be secured to one rod but not a second rod. For instance, the end assembly may be secured to an upper rod, while the end assembly is not secured to a lower rod (see e.g., FIG. 1). In this instance, a customer may remove items of merchandise supported on the lower rod without the need for a key, and the end assembly may be fixed to the upper rod. The lower rod of the display hook may have a series of bends at its free end to define an optional anti-sweeping feature. The anti-sweeping feature is designed to increase the amount of time required to remove an item of merchandise from the display hook, and in some instances, permits only one item of merchandise to be removed at a time. Thus, the anti-sweeping feature may prevent a shoplifter from removing all of the items of merchandise from the display hook at one time, referred to in the art as "sweeping."

The display hook comprises an alarm mechanism that is configured to generate a perceptible alarming signal (e.g., an audible, a visible, and/or haptic signal). For example, the alarm mechanism may be operably engaged with the end assembly and/or the rod and be configured to generate an alarming signal when an item of merchandise is removed from the rod. In some cases, it may be desirable to allow a customer to remove an item of merchandise without an alarming signal being generated. Thus, the alarm mechanism may not generate an alarming signal when one item of merchandise is removed from the rod. Should the customer remove a second item of merchandise within a predetermined period of time from the first item being removed, the alarm mechanism may generate a first alarming signal. The first alarming signal may serve as a subtle warning to the customer and may be only perceptible to the customer. The first alarming signal may be a "pre-alarm" having a minimal volume, intensity and/or duration. Thus, the first alarming signal may not be heard or seen by other customers that are not within the immediate vicinity of the display hook. When a third item of merchandise is removed by the customer within a predetermined period of time from the first or second item of merchandise being removed, the alarm mechanism may generate a second alarming signal that is more perceptible than the first alarming signal. As such, the second alarming signal may have a greater volume, intensity, and/or duration than the first alarming signal. Thus, the second alarming signal may serve as a more forceful warning to the customer. In the event that a fourth item of merchandise is removed from the rod within a predetermined period of time of the first, second, or third items, the alarm mechanism may generate an alarming signal that is more perceptible than the first and second alarming signals. Thus, the third alarming signal may provide an alarming signal that has a greater volume, intensity, and/or duration than the second alarming signal. As such, the second alarming signal may provide an indication to store personnel and/or security personnel that a predetermined threshold number of items of merchandise have been removed from the display hook within a predetermined period of time.

It is understood that the alarm mechanism may be configured to generate alarming signals in response to any number of items of merchandise being removed from the display hook. For example, the alarm mechanism may not generate an alarming signal after a predetermined acceptable number of items of merchandise have been removed (i.e., one or more items). The acceptable number may depend on the type of merchandise. Alternatively, the alarm mechanism may generate a first alarming signal when the first item of merchandise is removed. Such a first alarming signal may only be perceptible to the customer or other customers in the immediate vicinity of the customer. Any additional items of merchandise removed from the display hook may result in sequential alarming signals having increased volume, intensity, and/or duration with respect to a preceding alarming signal. After a predetermined number of alarming signals, the alarm mechanism may only be deactivated with a key or by suitable authorized personnel. As such, embodiments of the present invention allow customers to remove a first item of merchandise without the annoyance or anxiety of an alarming signal being generated. The removal of the first item of merchandise without generating an alarming signal may be thought of a "first free" concept, wherein the customer may freely remove an item of merchandise. However, the removal of a predetermined number of items of merchandise that may be indicative of theft or "sweep" may result in one or more alarming signals being generated. In addition, the alarm mechanism may be helpful in instances where a key has been obtained by an unauthorized user, and the user attempts to remove several items of merchandise.

The alarm mechanism may be disarmed with a key or after a predetermined period of time for generating an alarming signal has elapsed. The key may be the same key used to lock/unlock an end assembly or the base assembly (e.g., a magnetic key), or a separate key may be utilized. Such a key may utilize mechanical and/or an electronic functionality. In one embodiment, the key may utilize wireless signals, such as infrared signals, to communicate with the alarm mechanism or end assembly to arm or disarm the alarm mechanism. The key may also be configured to transmit a specific security code for arming or disarming the alarm mechanism. In one example, the key may utilize similar features as that disclosed by U.S. Pat. No. 7,737,845, entitled Programmable Key for Security System for Protecting Merchandise, the contents of which are hereby incorporated by referenced in its entirety. In some cases, an electronic key may be employed for locking or unlocking a passive lock in the end assembly and/or the base. For example, the key may be similar to that disclosed in U.S. Publ. No. 2012/0047972 entitled Electronic Key for Merchandise Security Device, the contents of which are hereby incorporated by referenced in its entirety.

In some embodiments, even if a key is used to unlock the end assembly, the alarm mechanism may still be configured to generate an alarming signal when a plurality of item of merchandise are removed from the rod. This functionality may be beneficial where a counterfeit key has been obtained and is used to unlock the end assembly. A second key may be required to disarm the alarm mechanism, such as an electronic key.

Moreover, the alarming signals may be generated based on a predetermined number of items of merchandise being removed within a predetermined period of time. The predetermined period of time may be measured from when the first item of merchandise has been removed, or between the removal of sequential items of merchandise. The period of time may be indicative of a single customer removing multiple items of merchandise. For example, the predetermined period of time may be about 20 seconds, about 15 seconds, about 10 seconds, or about 5 seconds.

Furthermore, it is understood that the alarming signal may be any suitable audible, visual, and/or haptic signal. For example, the alarming signal may be a "beep", alarm, siren, or the like with any desired duration and pattern. Likewise, a visual signal may be any suitable lighting, flashing, LED indictor, or the like. In addition, an example haptic signal may be a vibration signal that is generated as the item is being removed and that is perceptible to the customer.

In one embodiment, the end assembly and/or rod includes a sensor configured to detect removal of each item of merchandise from the rod. The sensor may be any mechanical, electronic, and/or optical sensor configured to sense removal of an item of merchandise. For example, the sensor may be an optical sensor configured to detect removal of an item of merchandise. In this regard, the optical sensor may be configured to detect changes in light as an item of merchandise is removed from the rod and generate an electrical signal indicative of the same. Thus, the sensor may be configured to detect each item of merchandise removed from the rod. In another embodiment, the sensor may include a switch (e.g., an electro-mechanical switch) whereby each item of merchandise contacts or otherwise triggers a switch when removed from the rod. Alternatively, movement of the end assembly may be sensed. For example, the end assembly may be configured to pivot to allow an item of merchandise to be removed. In addition, the end assembly may include a counter mechanism for determining or otherwise tracking the number of items of merchandise that have been removed and/or a period of time elapsed between removal of items. Furthermore, the end assembly may include a controller, circuitry, or the like for communicating electrical signals with the sensor, counter mechanism, and/or alarm mechanism. For example, the controller or circuitry may provide a signal to the counter mechanism when the sensor detects removal of an item of merchandise and may also provide a signal to the alarm mechanism to generate an alarming signal when the counter mechanism detects that a predetermined number of items have been removed within a predetermined period of time.

In one embodiment, the end assembly may be omitted, such as where the rod includes a sensor configured to detect removal of items of merchandise. An alarm mechanism could be integrated with the rod, base assembly, or display support and be in communication with the sensor (e.g., via wired or wireless communication).

Referring now to the accompanying drawing figures wherein identical reference numerals denote like elements throughout the various views, FIG. 1 shows two merchandise display hooks 20, 30 mounted to a common type of a display support 10, such as slatwall 12, utilized for supporting and displaying items of merchandise (not shown for purposes of clarity) in a retail store. It is understood that the display hooks 20, 30 may be used with other common types of display supports including pegboard, wire grid, and horizontal bar rack. Slatwall 12 includes a plurality of vertically spaced, horizontally-extending channels 14 configured to receive a portion of the display hook 20, 30 in sliding engagement with at least one of the channels. As a result, the location of the merchandise display hook 20, 30 on the slatwall 12 can be adjusted laterally along a channel 14 to optimize the horizontal spacing between adjacent display hooks or the vertical spacing between items of merchandise on adjacent display hooks. By adjusting the location of the merchandise display hooks 20, 30 in the lateral direction along the continuous channel 14, a retailer can take full advantage of the space, commonly referred to as the retail footprint, available on the slatwall 12.

As shown herein, the merchandise display hook 20 mounted within a channel 14 on slatwall 12 is a conventional "2-wire" display hook comprising an upper rod (or wire) 21 and a lower rod (or wire) 23. The upper rod 21 has a notch, flat, hook, or other engagement feature 22 at the free end for attaching an end assembly onto the display hook. The lower rod 23 of the display hook 20 has a series of bends at its free end to form an optional anti-sweeping feature 24. The anti-sweeping feature 24 is designed to increase the amount of time required to remove an item of merchandise from the display hook 20, and in some instances, permits only one item of merchandise to be removed at a time. The merchandise display hook 20 further comprises an optional locking mechanism adjacent the opposite end for locking the display hook to the slatwall 12. As shown herein, the locking mechanism comprises a lockable base 26 that is slidably disposed on the upper rod 21 and movable thereon between an unlocked position and the locked position shown in FIG. 1. The lockable base 26 includes a D-shaped recess 28 for receiving a magnetic key that releases a magnetically attractable locking member from engagement with the upper rod 21 to thereby permit the lockable base to slide along the upper rod from the locked position to the unlocked position.

As shown herein, the merchandise display hook 30 mounted within a channel 14 on slatwall 12 is a conventional "3-wire" display hook comprising an upper rod (or wire) 31 and a pair of lower rods (or wires) 33 joined at the free end to form a U-shaped support for displaying items of merchandise. The display hook 30 includes an optional label holder 32 that is formed on or secured to an end assembly 34 adjacent the free end of the display hook. As shown herein, the end assembly 34 may be a lockable end assembly that is slidably disposed on the upper rod 31 and is lockably disposed on the lower rods 33. The lockable end assembly 34 is movable on the upper rod 31 between an unlocked position and the locked position shown in FIG. 1 and includes a D-shaped recess 35 for receiving a magnetic key that releases a magnetically attractable locking member from engagement with the lower rods 33 to thereby permit the lockable end assembly to slide along the upper rod 31 from the locked position to the unlocked position. In the locked position, the lockable end assembly 34 prevents removal of the items of merchandise from the display hook 30, and consequently, also serves as an anti-sweeping feature to prevent a shoplifter from removing all of the items of merchandise from the display hook at one time. The merchandise display hook 30 further comprises an optional locking mechanism adjacent the opposite end for locking the display hook to the slatwall 12. As shown herein, the locking mechanism is a lockable base 36 that is slidingly disposed on the upper rod 31 and movable thereon between an unlocked position and the locked position shown in FIG. 1. The lockable base 36 includes a D-shaped recess 38 for receiving a magnetic key that releases a magnetically attractable locking member from engagement with the upper rod 31 to thereby permit the lockable base to slide along the upper rod 31 from the locked position to the unlocked position.

Figure 2:
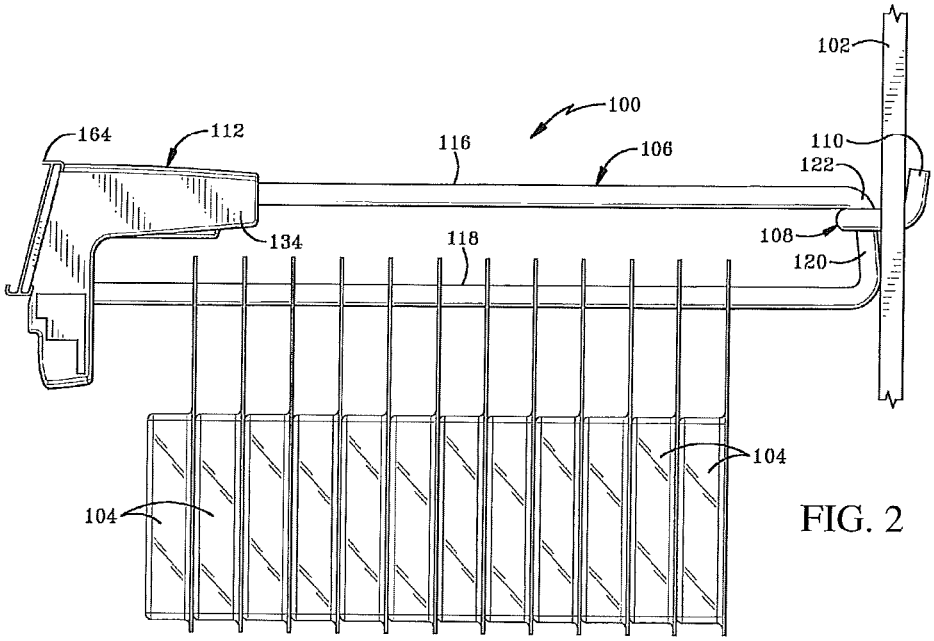
FIG. 2 is a side view of a merchandise display hook in a locked position according to one embodiment of the present invention.
Figure 3:
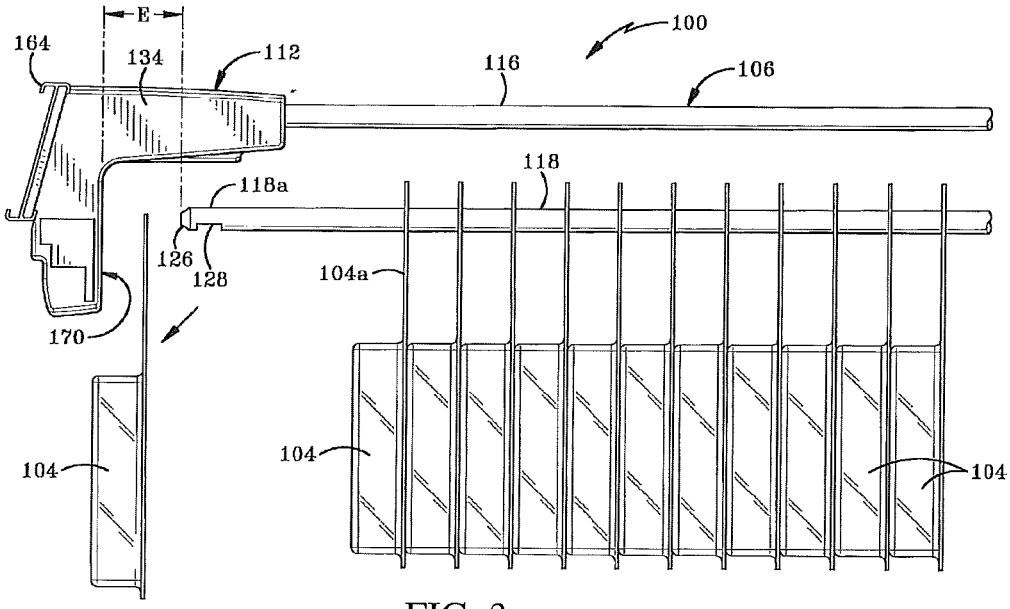
FIG. 3 is another side view of the merchandise display hook shown in FIG. 2 in an unlocked position.

According to additional embodiments shown in FIGS. 2 and 3, the display hook is used with a display board 102 (e.g., peg board or slat board) to support merchandise 104 for display in a retail environment. Display hook 100 comprises a rod assembly 106 and an end assembly 112. Rod assembly 106 includes substantially parallel first and second rods 116, 118 and a connecting rod 120 disposed therebetween. Rod assembly also includes an end 110 having one or more upwardly extending members that are receivable through holes in display board 102 to removably mount rod assembly 106 thereto in a cantilevered manner. Merchandise 104 is slidably engaged on second rod 118 and an end assembly 112 is provided to lockably secure merchandise 104 on second rod 118.

Rod assembly 106 includes the upper rod 116 and lower rod 118 which are joined together by a connecting rod 120. End 110 extends outwardly from a connector 108 adjacent an inner end 122 of upper rod 116. Each of these rods 116, 118, 120 and 108 may be generally cylindrical in cross section. Upper rod 116 may be shorter in length than lower rod 118 and terminate in end assembly 112. The free end of upper rod 116 may be permanently secured within end assembly 112. The free end **118*a* of lower rod 118 may extend outwardly beyond end 124 of upper rod 116 and terminate in a beveled and forward-extending tip 126. Lower rod 118 defines a downwardly facing notch 128 (FIG. 3) inwardly of tip 126**.

In accordance with one embodiment, end assembly 112 is provided to lockably secure free end **118*a* of lower rod 118 therein and to thereby prevent merchandise 104 from being removed from rod 118. For example, end assembly 112 may include housing 134 having a locking mechanism configured to engage notch 128 in a locked position and disengage notch in an unlocked position. End assembly 112 is movable along upper rod 116 between a locked position (FIG. 2) and an unlocked position (FIG. 3). When end assembly 112 is in the unlocked position, merchandise 104 can be removed from lower rod 118 due to separation of housing 134 from lower rod 118 (e.g., shown by distance "E"). When end assembly 112 is in the locked position, merchandise 104** cannot be removed therefrom. The end assembly may define an opening having a cross-sectional shape that is complementary to a key, as discussed above. For example, the opening may be generally D-shaped, although other shapes may be employed.

Figure 4:
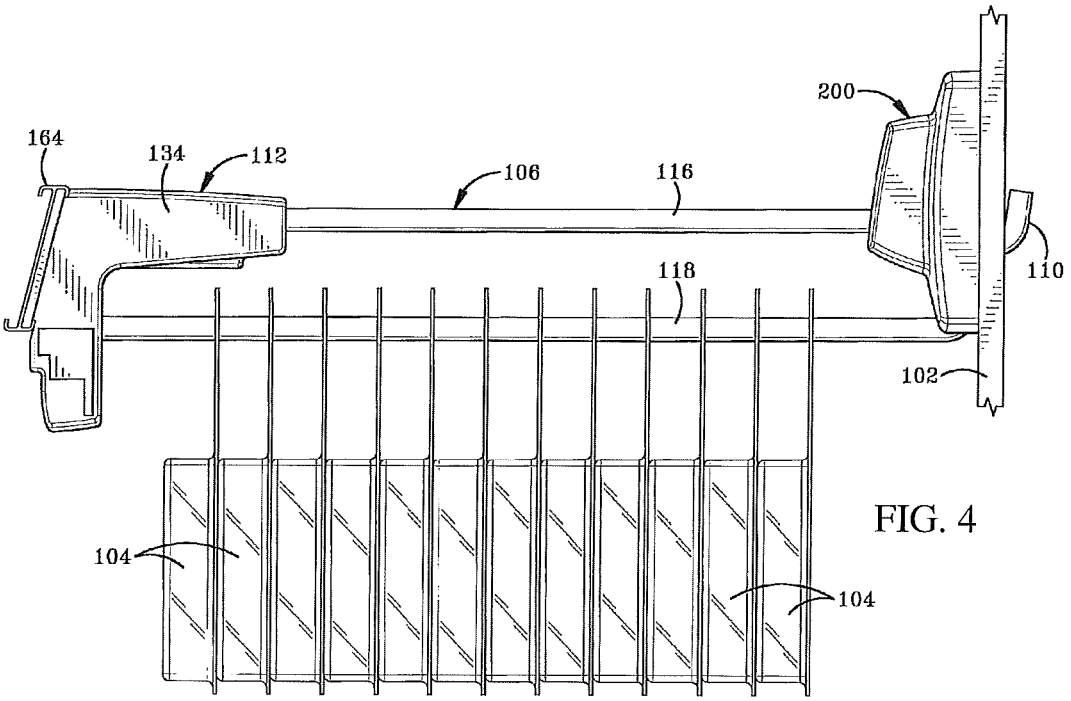
FIG. 4 is a side view of a merchandise display hook according to another embodiment of the present invention.

As shown in FIG. 4, the display hook may also include a base assembly 200 that is provided to securely lock rod assembly 106 to display board 102. A key may be used to unlock both of base assembly 200 and end assembly 112 as the base assembly 200 includes a locking mechanism.

Figure 5:
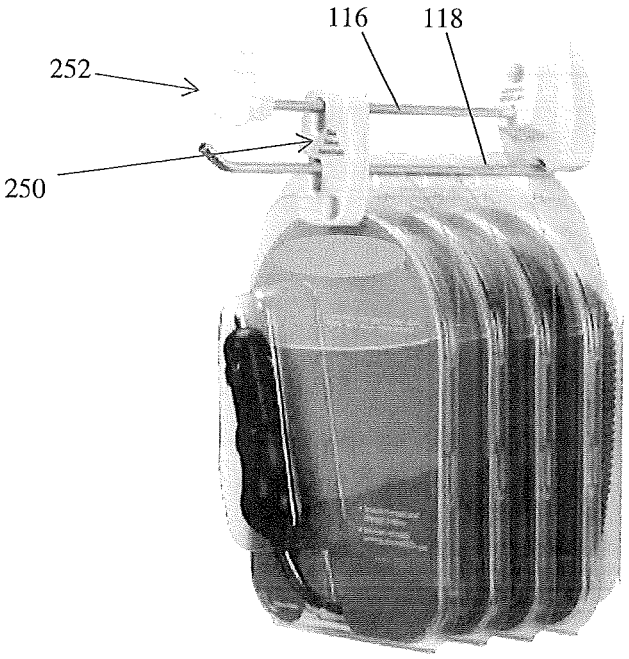
FIG. 5 is a perspective view of a merchandise display hook according to another embodiment of the present invention.
Figure 6:
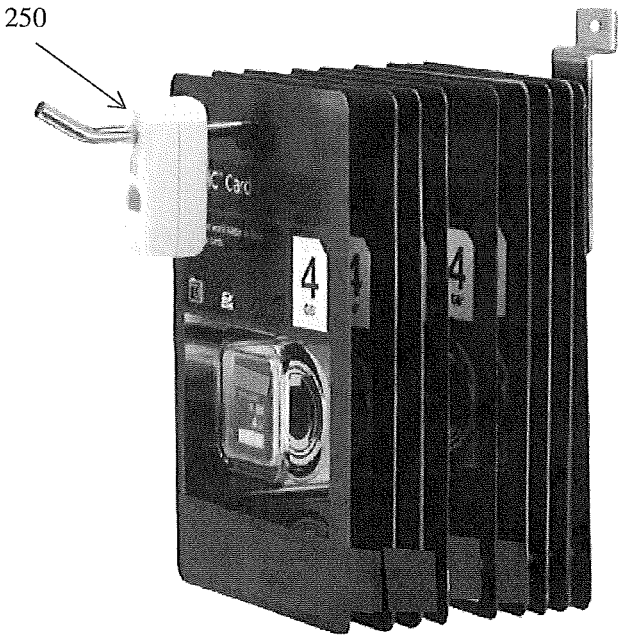
FIG. 6 is a perspective view of a merchandise display hook according to another embodiment of the present invention.

In the case where "flexible" locking hooks are employed, the retailer may choose the number of items of merchandise that may be removed without the need for a key or generation of an alarming signal (see e.g., FIGS. 5 and 6). In this regard, the locking hook includes an end assembly 250 with a locking mechanism that is configured to slide along and engage one or both of the rods. FIGS. 5 and 6 illustrate that one or more rods may be utilized with such a flexible locking mechanism. FIG. 5 also shows that the end assembly may alternatively be a label holder 252. The label holder 252 may be configured to pivot each time an item of merchandise is removed from the rod. The label holder 252 could include a sensor for detecting removal of items of merchandise and may not pivot in some embodiments. In some cases, the flexible locking hook may be unlocked with a key and removed from the rod(s), and the label holder and/or sensor may be used to detect removal of the items of merchandise from the rod(s). It is understood that the end assembly 250 and label holder 252 could be used independently of one another or in combination with one another according to various embodiments of the present invention.

Figure 7:
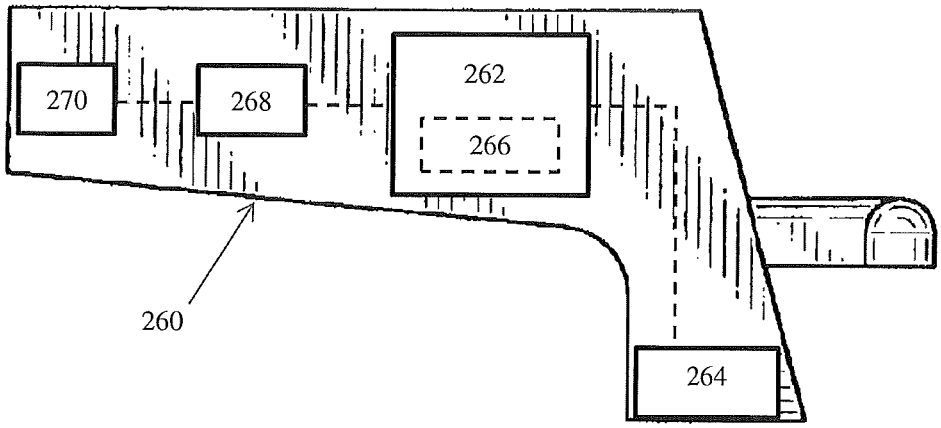
FIG. 7 is a side view of an end assembly according to another embodiment of the present invention.

FIG. 7 illustrates one embodiment of an end assembly 260. The end assembly 260 is configured to be fixed to an upper rod of a display hook, while a lower rod is configured to support items of merchandise. The end assembly 260 may only be fixed to the upper rod, although it is contemplated that the end assembly may removably lock to the lower rod as discussed above (see, e.g., FIGS. 2-4). The end assembly 260 generally includes a controller 262 and a sensor 264 in communication with the controller. As discussed above, the controller 262 and sensor 264 may communicate signals with one another, such as when the sensor detects the removal of an item of merchandise. As also discussed above, the end assembly 260 may include a counter mechanism 266 for counting the number of items of merchandise removed and/or the elapsed time between removal of items. It is understood that such a counter mechanism 266 may be integrated with the controller 262 or be a separate component in communication with the controller. Similarly, the sensor 264 and counter mechanism 266 could be integrated as a single component if desired. Furthermore, the end assembly 260 includes an alarm mechanism 268 or suitable alarm in communication with the controller 262. The alarm mechanism 268 is configured to generate one or more alarming signals as discussed in detail above. In one embodiment, the controller 262 may be optional or unnecessary where the alarm mechanism 268 and sensor 264 are configured to communicate directly with one another. For example, the alarm mechanism 268 may be configured to generate an alarming signal when a signal is received from the sensor 264. In addition, the alarm mechanism 268 could also incorporate a counter mechanism 266 for determining the number of items of merchandise removed based on one or more signals received from the sensor 264, as well as determine the elapsed time between removal of items. Moreover, the display hook may include a power source 270, such as a battery, to provide power to each of the components requiring power, such as the sensor 264, controller 262, and/or alarm mechanism 268. In one embodiment, the battery may be disposed within the end assembly and electrically connected with the sensor, controller, and/or alarm mechanism.

Figure 8:
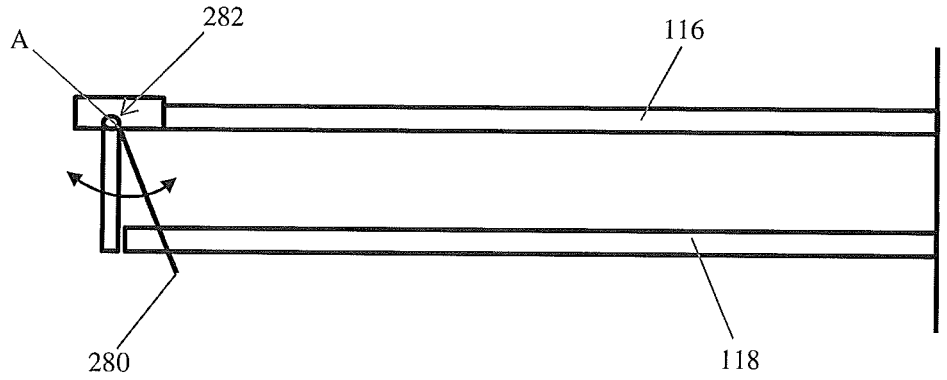
FIG. 8 is a side view of a merchandise display hook according to another embodiment of the present invention.

In another embodiment, the display hook may further include a lock mechanism 280 (see, e.g., FIG. 8). In one embodiment, the display hook may include an end assembly 282 that pivots and such pivoting may indicate that an item of merchandise has been removed from the rod. In this embodiment, the end assembly 282 is coupled to the upper rod 116, while items of merchandise may be supported on the lower rod 118. In the illustrated embodiment, the end assembly 282 may be a label holder (see also FIGS. 1 and 5) that is configured to pivot each time an item of merchandise is removed from the rod 118, and such pivoting may be detectable to indicate that an item has been removed. A lock mechanism 280 may be utilized in the instance where an upper rod 116 and a lower rod 118 are employed. In one example, the lock mechanism 280 may be a physical lock that is operably engaged with the end assembly 282 and may be configured to pivot with the end assembly. For example, the end assembly 282 and the lock mechanism 280 may pivot together about an axis "A". The lock mechanism 280 could be a U-shaped member or other device configured to extend around or otherwise engage the lower rod 118 such that items of merchandise may not be removed from the lower rod when the lock mechanism is in a locked position. The lock mechanism 280 may be used to prevent the lower rod 118 from being displaced away from the upper rod 116. Pivoting or disengagement of the lock mechanism 280 with the lower rod 118 may be detectable and in one embodiment and may result in the generation of an alarming signal. Thus, a potential thief would be unable to pivot or bend the lower rod 118 away from the upper rod 116 to remove items of merchandise without first pivoting the end assembly 282. In particular, the potential thief would be unable to remove an item of merchandise without first pivoting the end assembly 282 to disengage the lock mechanism 280 from the lower rod 118. And as noted above, pivoting the end assembly 282 would be detectable such that a thief would be hindered from removing merchandise without first pivoting the end assembly.

The foregoing has described one or more embodiments of a display hook of the type commonly used to display items of merchandise. Embodiments of a display hook have been shown and described herein for purposes of illustration. Those of ordinary skill in the art, however, will readily understand and appreciate that numerous variations and modifications of the invention may be made without departing from the spirit and scope of the invention.

That which is claimed is:

1. A display hook for displaying items of merchandise, the display hook comprising:

at least one rod for supporting a plurality of items of merchandise;

a sensor operably engaged with the at least one rod and configured to detect removal of the items of merchandise from the at least one rod; and an alarm mechanism in communication with the sensor and configured to generate at least one alarming signal, wherein the alarm mechanism is configured to not generate an alarming signal when at least a first item of merchandise is removed from the rod, and wherein the alarm mechanism is further configured to generate an alarming signal when at least a second item of merchandise has been removed from the rod within a predetermined period of time from the first item of merchandise being removed.

2. The display hook of claim 1, further comprising an end assembly coupled to the at least one rod, wherein the end assembly is operably engaged with the sensor.

3. The display hook of claim 2, further comprising an upper rod and a lower rod, wherein the lower rod is configured to support the items of merchandise, and wherein the end assembly is engaged with at least the upper rod.

4. The display hook of claim 3, wherein the end assembly is configured to be removably locked to the lower rod.

5. The display hook of claim 3, further comprising a lock mechanism operably engaged with the end assembly and configured to engage the lower rod to prevent the lower rod from being displaced away from the upper rod, the lock mechanism further configured to disengage the lower rod in response to movement of the end assembly.

6. The display hook of claim 2, wherein the at least one rod comprises a free end, and wherein the end assembly is coupled to the free end of the rod.

7. The display hook of claim 2, wherein the at least one rod comprises a free end, and wherein the end assembly is spaced away from the free end of the rod.

8. The display hook of claim 1, wherein the alarming mechanism is integrated with the end assembly.

9. The display hook of claim 1, further comprising a base assembly coupled to the at least one rod and configured to lock the rod to a display support.

10. The display hook of claim 1, wherein the alarming signal comprises an audible signal.

11. The display hook of claim 10, wherein the alarm mechanism is configured to generate a plurality of alarming signals, each alarming signal being different than one another.

12. The display hook of claim 11, wherein each alarming signal has a different volume, intensity, and/or duration.

13. The display hook of claim 1, further comprising a counter configured to count the number of items of merchandise removed and/or the elapsed time between removal of items of merchandise.

14. A display hook for displaying items of merchandise, the display hook comprising:

at least one rod for supporting a plurality of items of merchandise; and an end assembly coupled to the at least one rod, the end assembly comprising an alarm mechanism configured to generate at least one alarming signal, wherein the end assembly is configured to detect removal of each item of merchandise, wherein the alarm mechanism is configured to not generate an alarming signal when at least a first item of merchandise is removed from the rod, and wherein the alarm mechanism is further configured to generate an alarming signal when at least a second item of merchandise has been removed from the rod within a predetermined period of time from the first item of merchandise being removed.

15. The display hook of claim 14, wherein the end assembly comprises a sensor configured to detect removal of each item of merchandise.

16. A method for protecting an item of merchandise from theft, the method comprising:

detecting removal of at least a first item of merchandise from a rod;

detecting removal of at least a second item of merchandise from the rod; and generating a first alarming signal when the second item of merchandise is removed from the rod within a predetermined period of time from the first item of merchandise being removed, wherein an alarming signal is not generated when the first item of merchandise is removed from the rod.

17. The method of claim 16, further comprising counting a number of items of merchandise removed from the rod.

18. The method of claim 16, further comprising counting an elapsed time between removal of items of merchandise from the rod.

19. The method of claim 16, further comprising detecting removal of a third item of merchandise and generating a second alarming signal when the third item of merchandise is removed from the rod within a predetermined period of time of the second item of merchandise being removed, wherein the second alarming signal has a greater volume, intensity, and/or duration than the first alarming signal.

* * * * *